US008556224B2

(12) United States Patent
Kharchenko et al.

(10) Patent No.: US 8,556,224 B2
(45) Date of Patent: Oct. 15, 2013

(54) ADHESIVELY MOUNTABLE BATHROOM ACCESSORIES

(75) Inventors: Semen Kharchenko, Ann Arbor, MI (US); William H. Spencer, Jr., Burlington, NC (US); Helli Marie McDaniel, Whitsett, NC (US); Michael Glenn Geels, Jackson, TN (US); Jigui Li, Irvine, CA (US); Hyun Moon, Bloomfield Hills, MI (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 256 days.

(21) Appl. No.: 13/050,384

(22) Filed: Mar. 17, 2011

(65) Prior Publication Data

US 2012/0233932 A1 Sep. 20, 2012

(51) Int. Cl.
*A47G 29/00* (2006.01)

(52) U.S. Cl.
USPC ..... 248/683; 248/201; 248/205.3; 248/251; 4/576.1; 4/611

(58) Field of Classification Search
USPC ..... 248/683, 467, 201, 205.3, 205.4, 251; 4/548, 559, 571.1, 576.1, 577.1, 605, 4/611
See application file for complete search history.

(56) References Cited

U.S. PATENT DOCUMENTS 1,581,658 A 4/1924 Owens
2,067,591 A * 1/1937 Balmer ..... 4/576.1
2,472,004 A 2/1946 Czerniewicz
2,679,998 A 10/1949 Keller
2,647,711 A 12/1950 Margulis
2,580,231 A * 12/1951 Lamm ..... 248/67.7
3,012,748 A 12/1961 Breslow
3,165,283 A 1/1965 Borisof
3,260,372 A 7/1966 Jauslin
3,311,339 A 3/1967 Frye
3,504,878 A 4/1970 Dressler
3,637,181 A 1/1972 Janssen
3,853,225 A * 12/1974 Gegauff ..... 211/85.3
3,885,768 A 5/1975 Frye
4,309,011 A * 1/1982 Spector ..... 248/205.3
4,310,137 A 1/1982 Frye
4,317,555 A 3/1982 Hogg
4,671,480 A 6/1987 Frye
4,756,498 A 7/1988 Frye
4,870,907 A 10/1989 McKee
4,942,071 A 7/1990 Frye
5,121,896 A 6/1992 Frye
5,340,070 A * 8/1994 Soma ..... 248/220.1
5,409,189 A 4/1995 Luhmann
5,433,152 A 7/1995 Henry
5,437,428 A * 8/1995 Mirza ..... 248/467
5,507,464 A * 4/1996 Hamerski et al. ..... 248/683

(Continued)

*Primary Examiner* — Bradley Duckworth
(74) *Attorney, Agent, or Firm* — Carlson, Gaskey & Olds, PC

(57) ABSTRACT

A bar that is to be attached to a wall includes two stanchions, each stanchion supporting a portion of an elongated piece that extends from one stanchion to the other. A supporting connector having a lower portion attaches to and extends upwardly from each of the stanchions and a portion above the lower portion. A horizontal support extends horizontally from the portion above the lower portion of the connector between the stanchions and is disposed a distance D1 above each the stanchion. And, an adhesive is disposed beneath and attaches to the horizontal support and extends along a length thereof.

19 Claims, 3 Drawing Sheets

(56) References Cited

U.S. PATENT DOCUMENTS

| | | | | |
|---|---|---|---|---|
| 5,621,927 | A * | 4/1997 | Reiss et al. | 4/559 |
| 5,921,514 | A | 7/1999 | Schumann | |
| 5,989,708 | A | 11/1999 | Kreckel | |
| 6,004,642 | A | 12/1999 | Langford | |
| 6,106,937 | A * | 8/2000 | Hamerski | 428/343 |
| 6,228,194 | B1 | 5/2001 | Cowen | |
| 7,078,093 | B2 | 7/2006 | Sheridan et al. | |
| 7,603,728 | B2 * | 10/2009 | Roth | 4/577.1 |
| 7,673,420 | B2 * | 3/2010 | Madesh | 52/34 |
| 8,122,530 | B1 * | 2/2012 | Bailey et al. | 4/576.1 |
| 2001/0028022 | A1 * | 10/2001 | Hamerski et al. | 248/205.3 |
| 2003/0211317 | A1 | 11/2003 | Sheridan et al. | |
| 2005/0263654 | A1 | 12/2005 | Grillo | |
| 2007/0096003 | A1 | 5/2007 | Kuo Liao | |
| 2007/0257165 | A1 * | 11/2007 | Newbould et al. | 248/205.3 |
| 2008/0053934 | A1 | 3/2008 | Newbould et al. | |
| 2008/0067319 | A1 * | 3/2008 | Sheffield et al. | 248/683 |
| 2008/0283715 | A1 | 11/2008 | Morrison | |
| 2012/0097692 | A1 * | 4/2012 | Wang | 220/737 |

* cited by examiner

ADHESIVELY MOUNTABLE BATHROOM ACCESSORIES

BACKGROUND

Bath accessories used in the bathroom, such as towel bars and hooks, are typically attached to walls by screws. Screws are particularly effective in holding large loads if they are anchored in a joist. Screws may not be used to attach accessories to dry wall if they are not anchored in a joist because excess weight on the accessory may cause the screw to pull out of the drywall. Some accessories are attached to walls by adhesives and double sided tape.

SUMMARY

According to an embodiment described herein, a bar that is to be attached to a wall includes two stanchions, each stanchion supporting a portion of an elongated piece that extends from one stanchion to the other. A supporting connector having a lower portion attaches to and extends upwardly from each of the stanchions and a portion above the lower portion. A horizontal support extends horizontally from the portion above the lower portion of the connector between the stanchions and is disposed a distance D1 above each the stanchion. And, an adhesive is disposed beneath and attaches to the horizontal support and extends along a length thereof.

According to a further embodiment described herein, an accessory that is to be attached to a wall has a stanchion supporting a piece extending from the stanchion, a supporting connector having a lower portion attaching to and extending upwardly from the stanchion and a portion above the lower portion, a horizontal support extending horizontally from the upper portion of the connector, and a tape disposed beneath and attaching to the horizontal support and extending along a length thereof According to a still further embodiment described herein, a bar that is to be attached to a wall has two stanchions, each stanchion supporting a portion of an elongated piece extending from one stanchion to the other. Each of a first and second supporting connector has a lower portion attaching to and extending upwardly from one of the stanchions and a portion above the lower portion. A first horizontal support extends horizontally from one of the portions above the lower portion of the connector between the stanchions. A second horizontal support extends horizontally from an other of the portions above the lower portion of the connector between the stanchions, wherein the first and second horizontal supports do not touch and wherein at least one of the first and second horizontal supports is disposed a distance D1 above each the stanchion. And an adhesive is disposed beneath and attaching to each of the first and second horizontal supports and extending along lengths thereof.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION

Figure 1:
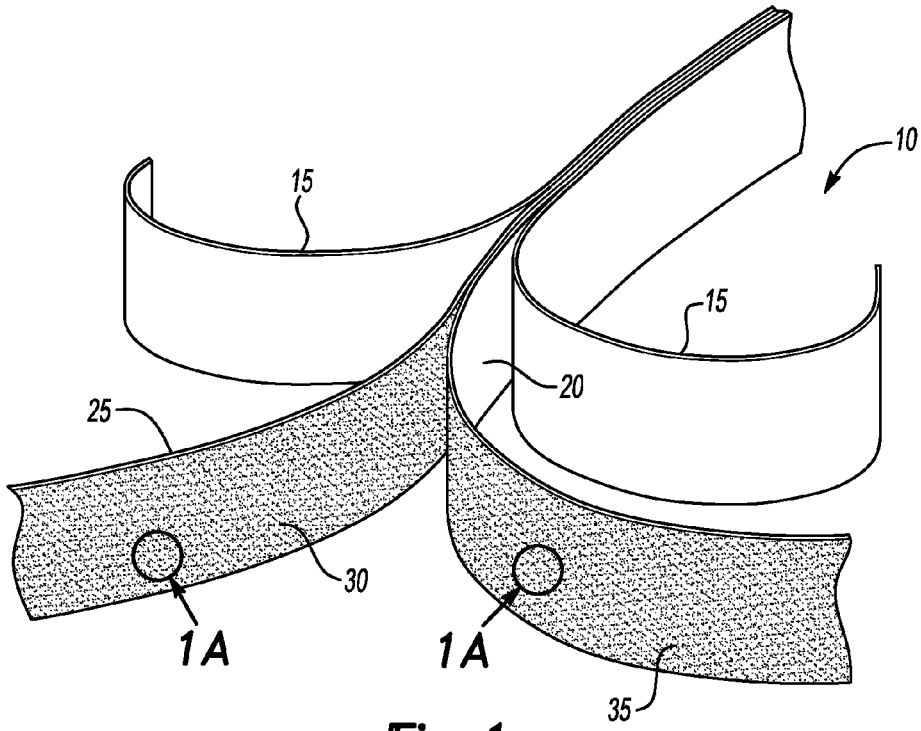
Fig-1 PRIOR ART
FIG. 1 is a prior art depiction of a typical removable tape.
Figure 1A:
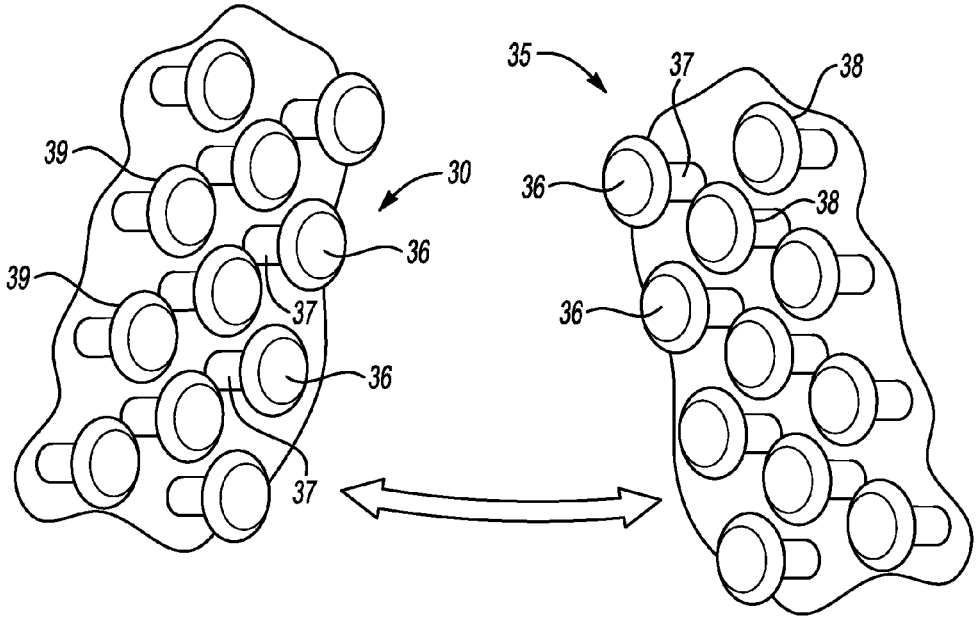
Fig-1A PRIOR ART
FIG. 1A represents two portions of FIG. 1 taken along the lines 1A

Referring to FIGS. 1 and 1A, perspective view of a replaceable tape system 10 is shown. The system 10 shown herein is a 3M™ Dual Lock™ reclosable fastener that may be acquired from the 3M Corporation. Other attachment tapes, such as hook and loop tapes and adhesives, are also contemplated herein.

The replaceable tape system 10 includes backing tape 15, an outer adhesive layer 20, an inner adhesive layer 25, an inner releasable tape 30 having a plurality of mushroom-shaped heads 36 thereupon, and an outer releasable tape 35 having a plurality of mushroom-shaped heads 36 thereupon. The mushroom-shaped heads 36 extending from stems 37. The mushroom shaped heads 36 have undersides 38 on releasable tape 30 that interlock with undersides 39 of mushroom heads 36 on releasable tape 35.

Typically, the backing tape 15 is removed from the inner adhesive layer 25 and attached to a surface (not shown) and then a fixture (not shown) is attached to the outer adhesive layer 20 at which point the fixture is removably affixed to the surface. To remove the fixture, the inner releasable tape 30 and outer releasable tape 35 may be pealed apart from the ends thereof.

The inner and outer releasable tapes 30, 35 have good resistance to shear force, normal force and bending moments due to loads. However, the replaceable tape system 10 is not always usable with accessories, such as a towel bar, if higher loads are required to be supported by that accessory. While the accessory shown herein is a towel bar, other accessories such as robe hooks, toilet paper holders, towel rings etc, are contemplated herein.

Figure 2:
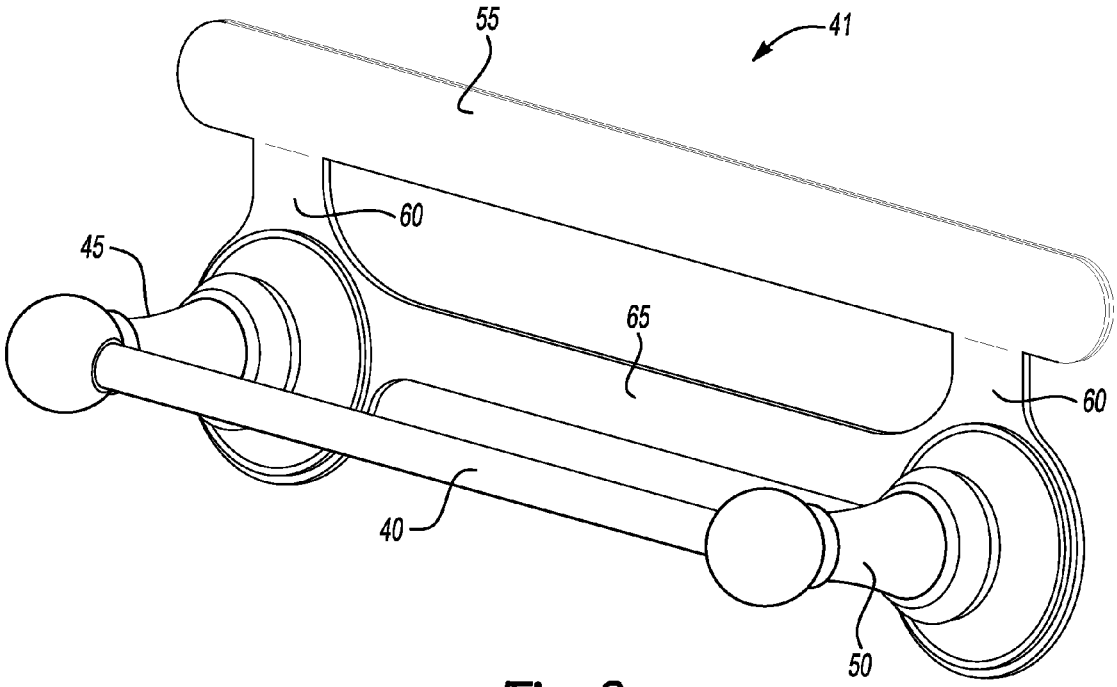
FIG. 2 is a perspective view of a towel bar.

Referring now to FIG. 2, an accessory, such as towel bar 41 (e.g., an elongated piece), is shown. A bar 40 is held at either end by a stanchion 50 (e.g., a holder). The stanchions are attached together via a lower support 65 and to an upper support 55 via support connectors 60.

Figure 3:
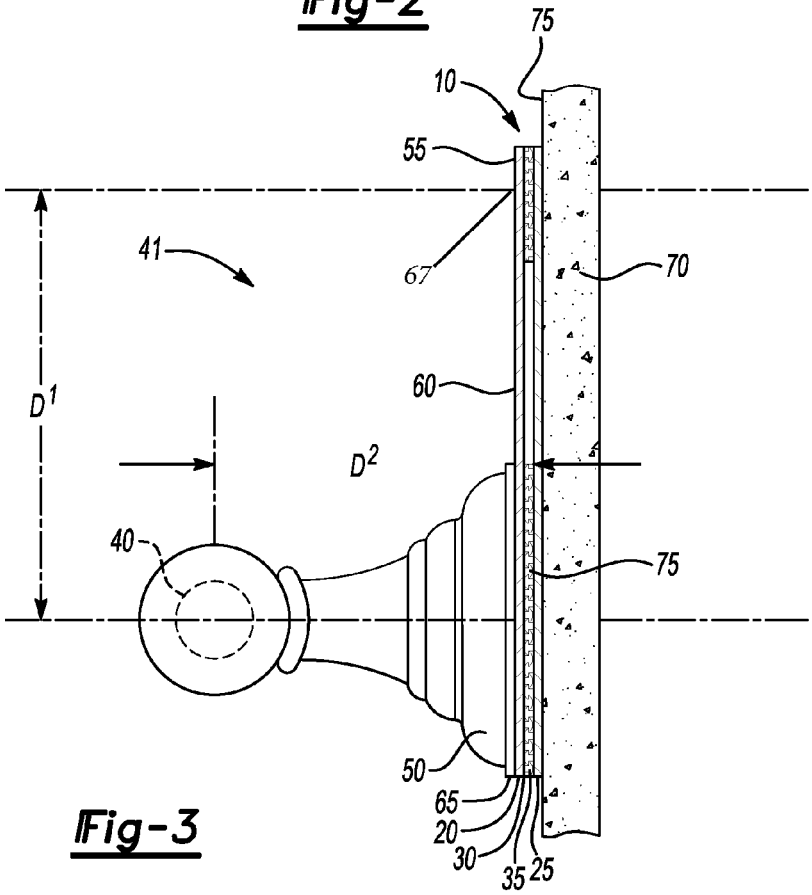
FIG. 3 is a side view of the towel bar of FIG. 2.

Referring now to FIG. 3, a side view of the towel bar 41 of FIG. 2 is shown. Each stanchion 50 backs up onto lower support 65 and connector 60 attaches to the upper support 55. The replaceable tape system 10 and its layers, adhesive layer 20, inner releasable tape 30, outer releasable tape 35, and inner adhesive layer 25 attach to a piece of drywall 70. Typically the drywall has a facing layer 75 made of paper, although other materials are known. The layers of the replaceable tape system 10 are exaggerated in dimension for ease of illustration.

The towel bar extends a distance D2 beyond the lower support 65 and the towel bar is approximately a distance D1 below the center point 67 of the upper support 55. Typically if the distance D2 is 3 inches and the distance $D^1$ is 4½ inches, the towel bar will support 50 pounds. If the distance D2 is reduced from 3 inches to 2½ inches, the upper stanchion support 55 the distance D1 may only need to be 3¾ inches. The ratio of D1 to D2 is about 1.5:1. For example if the upper support 55 is 24" long, the fixture will support 50 pounds of load and if the upper support 55 is 12", for example, the fixture will support 25 pounds of load. If the distance D2 is reduced from 3 inches to 2½ inches, the distance D1 may only need to be 3¾ inches to support similar loads. The ratio of D1 to D2 is still about 1.5:1.

The replaceable tape system 10 need only extend along the length of the upper support 55 to be effective to hold the required load. However, to stabilize the towel bar 41 if it experiences upward moments (e.g., if a user pulls a towel upwardly to remove it), the releasable tape system 10 can be also placed and directly behind (see 75 in FIG. 3) each stanchion 45, 50 where they contact the lower support 65. The placement of the releasable tape system 10 behind the right stanchion 50 and the left stanchion 45 prevents the towel bar from experiencing peal force that may separate the inner releasable tape 30 in the outer releasable tape 35.

The upper and lower supports 55 and the support connector 60 may be made of metal, plastic, or other rigid material so that the loads are borne on the releasable tape system 10 disposed under the upper support 65 and upper supports 65*a* and 65*b* as will be discussed infra. Though the upper and lower supports 55 and 65 are shown as separate pieces as are support connectors 60, they may all be one broad piece. The releasable tape system 10 underneath the upper support 55 is typically one inch wide and runs the length of the upper support 55.

Figure 4:
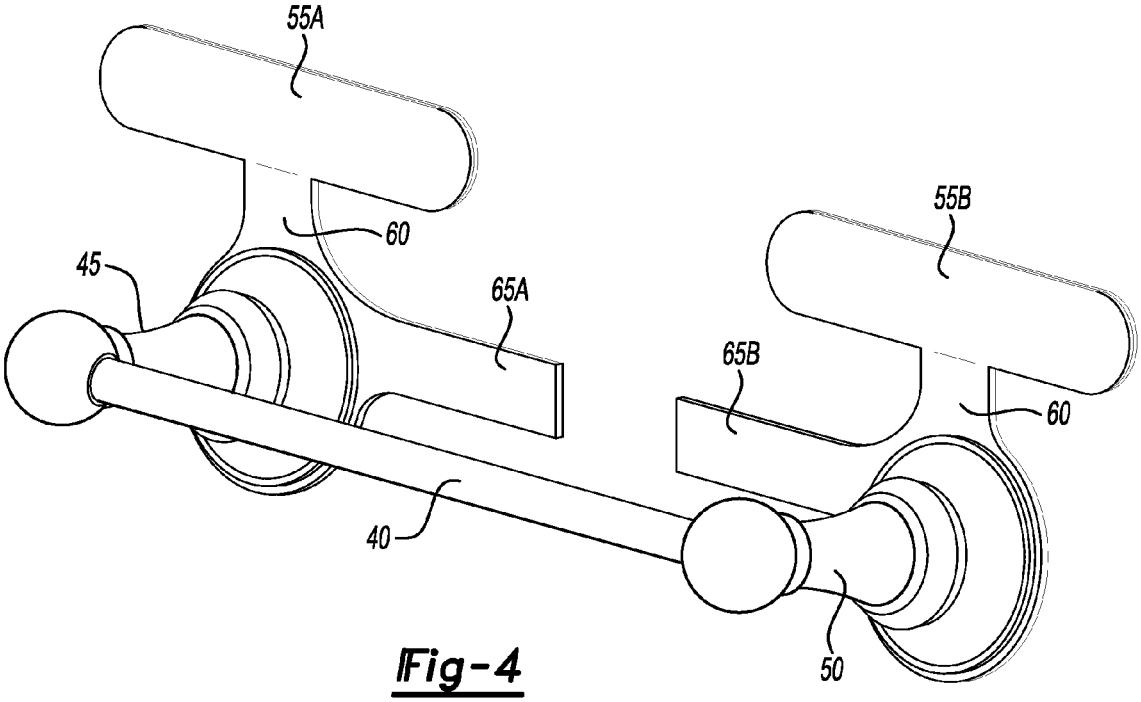
FIG. 4 is a perspective view of another embodiment of a towel bar.

Referring now to FIG. 4, a second embodiment of a towel bar 87 is shown herein. In this embodiment, the lower support 65 is split into a left lower support 65*a* and a right lower support 65*b*. Similarly, the upper support 55 is split into a left upper support 55*a* and a right support 55*b*. Again, the tape is typically one inch wide and runs the length of 55*a* and 55*b*. On the lower supports 65*a* and 65*b* the tape is only placed under the lower supports 65*a* and 65*b* where they contact stanchions 45, 50.

Figure 5:
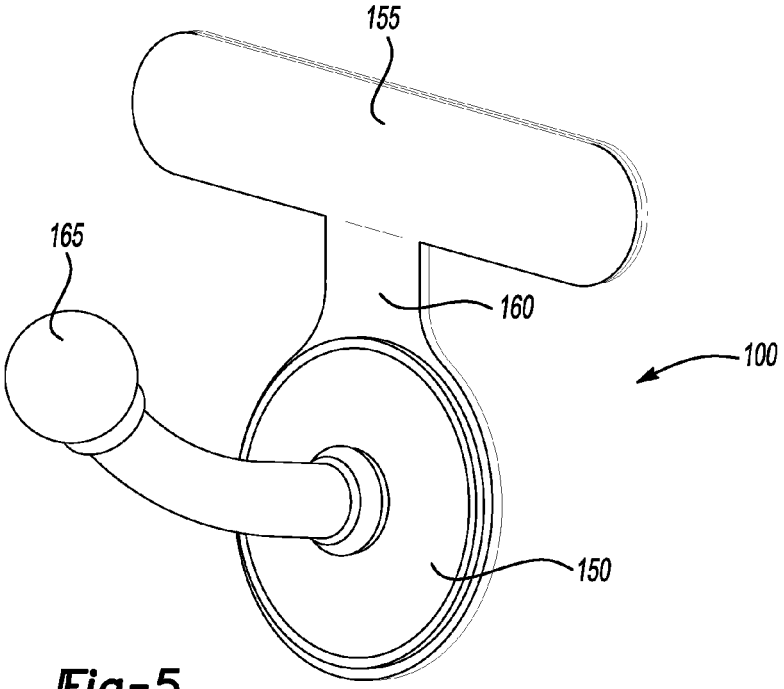
FIG. 5 is a perspective view of a view of a further embodiment shown herein

Referring now to FIG. 5, a further embodiment is shown herein. An accessory such as a robe hook 100, which may be attached to a wall, has a stanchion 150 (e.g., a holder) attaching to an upper support 155 via a support connector 160. A holder such as a hook 165 extends from the stanchion 150. The holder may be any shape required to hold a particular article such as a robe, a hat, a strap or the like. As with the towel bar 41, the system 10 is disposed between the stanchion 150 and a wall 70 (see FIG. 3) and the upper support 155 and the wall 70.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bar for attaching to a wall, said bar comprising;

at least two holders, each holder supporting a portion of an elongated piece extending in a direction from one holder toward an adjacent holder, at least two supporting connectors, each supporting connector having a lower portion attaching to and extending upwardly from one of said holders and an upper portion above said lower portion, a horizontal support attaching to and extending horizontally from each upper portion of said supporting connectors, said horizontal support being disposed a first distance above said elongated piece, and wherein said horizontal support comprises an upper support and including a lower support attaching to and extending horizontally from said lower portion of each of said supporting connectors in a direction from one holder toward an adjacent holder, and an adhesive disposed beneath and attaching to said horizontal support and extending along a length thereof.

2. The bar of claim 1 further comprising:

wherein each supporting connector extends upwardly from one holder such that said lower portion is attached to said holder and said upper portion is directly attached to said horizontal support, and wherein said horizontal support extends from said upper portion of one supporting connector to the upper portion of the other supporting connector.

3. The bar of claim 1 wherein said first distance extends from a center of said horizontal support to a center of said elongated piece, and wherein said center of said elongated piece is a second distance away from said lower support, and a ratio of the first distance to the second distance is about 1.5:1.

4. The bar of claim 1 wherein said adhesive comprises a tape that is separable.

5. The bar of claim 1 wherein a tape is disposed behind each of said holders for attaching to a wall.

6. The bar of claim 5 wherein tape is only disposed behind each holder and said horizontal support.

7. The bar of claim 1 wherein at least one of said holders is a stanchion.

8. A bar for attaching to a wall, said bar comprising;

at least two holders, each holder supporting a portion of an elongated piece extending from one holder to another holder, first and second supporting connectors, each of said first and second supporting connectors having a lower portion attaching to and extending upwardly from one of said holders and an upper portion above said lower portion, a first horizontal support extending horizontally between said upper portions of said first and second supporting connectors, a second horizontal support extending horizontally between said lower portions of said first and second supporting connectors, wherein said first and second horizontal supports do not touch each other, wherein said first horizontal support is disposed a first distance above each holder, and an adhesive disposed beneath and attaching to each of said first and second horizontal supports and extending along lengths thereof.

9. The bar of claim 8 wherein said first distance extends from a center of said first horizontal support to a center of said elongated piece, and wherein said center of said elongated piece is positioned at a second distance from said second horizontal support, and a ratio of the first distance to the second distance is about 1.5:1.

10. The bar of claim 8 wherein said adhesive is separable.

11. The bar of claim 8 wherein a tape is disposed behind each of said holders for attaching to a wall.

12. The bar of claim 11 wherein said adhesive comprises tape and wherein tape is only disposed behind said holders and said first and said second horizontal supports.

13. An accessory for attaching to a wall, said accessory comprising:

at least first and second holders configured to support a rigid accessory member at a distance spaced from the wall, at least first and second supporting connectors each having a lower portion connected to one of said holders and extending vertically to an upper portion, a first support attached to said upper portion and extending in a horizontal direction, and with each lower portion of said first and second supporting connectors attaching to and extending from one holder to said upper portion, wherein said first support comprises an upper support and including a first lower support extending horizontally from said lower portion of said first supporting connector toward said second supporting connector and a second lower support extending horizontally from said lower portion of said second supporting connector toward said first supporting connector, and a tape disposed beneath and attaching to said holder and said first support and extending along a length thereof.

14. The accessory of claim 13 wherein said rigid accessory member comprises a towel bar.

15. The accessory of claim 13 wherein said rigid accessory member comprises a hook.

16. The accessory of claim 13 wherein said upper portion is attached to a center portion of said first support.

17. The accessory of claim 13 wherein said first and second lower supports are connected to each other.

18. The accessory of claim 13 wherein said upper support comprises a first upper support that extends horizontally from said upper portion of said first supporting connector toward said second supporting connector and a second upper support extending horizontally from said upper portion of said second supporting connector toward said first supporting connector.

19. The accessory of claim 18 wherein said first and second upper supports are connected to each other.

* * * * *